US007284725B2

(12) United States Patent
Inana

(10) Patent No.: US 7,284,725 B2
(45) Date of Patent: Oct. 23, 2007

(54) RECORDING PAPER STORAGE DEVICE

(75) Inventor: Katsuya Inana, Saitama (JP)

(73) Assignee: Fujifilm Corporation, Tokyo (JP)

( * ) Notice: Subject to any disclaimer, the term of this patent is extended or adjusted under 35 U.S.C. 154(b) by 1071 days.

(21) Appl. No.: 10/374,990

(22) Filed: Feb. 28, 2003

(65) Prior Publication Data

US 2003/0164994 A1 Sep. 4, 2003

(30) Foreign Application Priority Data

Mar. 4, 2002 (JP) ..... 2002-057780

(51) Int. Cl.
*B65H 75/24* (2006.01)

(52) U.S. Cl. ..... 242/578.2; 242/578; 242/591; 242/596.4; 242/596.7

(58) Field of Classification Search ..... 242/348, 242/348.2, 348.3, 348.4, 588, 588.3, 588.5, 242/588.6, 591, 332.5, 564, 564.3, 564.4, 242/578, 578.2, 596.7, 596.8
See application file for complete search history.

(56) References Cited

U.S. PATENT DOCUMENTS 5,911,380 A * 6/1999 Shiba ..... 242/348
6,412,725 B2 * 7/2002 Inana et al. ..... 242/348
6,412,726 B2 * 7/2002 Inana et al. ..... 242/348.4
6,824,091 B2 * 11/2004 Inana ..... 242/578.2
7,084,893 B2 * 8/2006 Kato
7,168,650 B2 * 1/2007 Inana et al. ..... 242/348

FOREIGN PATENT DOCUMENTS

JP 10-291350 11/1998
JP 2001-192152 7/2001

* cited by examiner

*Primary Examiner*—William A. Rivera
(74) *Attorney, Agent, or Firm*—Sughrue Mion, PLLC

(57) ABSTRACT

A paper holder is attachable to a recording paper storage chamber of a printer. The paper holder has a loading lid to cover a part of the recording paper storage chamber. And a press mechanism to press the rolled recording paper to a paper-supply roller is incorporated. The press mechanism consists of a first press plate and a second press plate. In receipt of a slight urge by a torsion coil spring, the first press plate presses the rolled recording paper to the paper-supply roller. On closing the loading lid of the recording paper storage chamber, the hold-down section of the loading lid presses the second press plate, which compresses a compression spring with the first press plate, to apply its counterforce to the first press plate.

17 Claims, 12 Drawing Sheets

RECORDING PAPER STORAGE DEVICE

BACKGROUND OF THE INVENTION

1. Field of the Invention

The present invention relates to a recording paper storage device that is disposed in a recording device like a printer, for storing a rolled recording paper in a replaceable manner.

2. Explanations of the Prior Arts

A recording device like a printer has a paper supply magazine as a recording paper storage device. The paper supply magazine, disclosed in JPA.No.10-291350, has a case body to store a rolled recording paper and a lid. The case body incorporates a paper supply roller. Driven from the moving mechanism in the printing section, the paper supply roller makes rotation to transport the rolled recording paper from the paper supply magazine into the printing section. To surely transport the rolled recording paper, the paper supply magazine has a press mechanism to press the outer surface of the rolled recording paper to the paper supply roller at all times. The press mechanism has a press lever and a spring. The press lever is disposed movable between a press position in which the press lever contacts both edges of a paper holder for biasing the rolled recording paper so that the rolled recording paper is pressed onto the paper-supply roller, and a release position in which the press lever parts from the both edges in order to release the paper holder. The spring is attached to the press lever and the lid. When the lid is open, the press lever is pulled by the spring to move to the release position. Meanwhile, when the lid is closed, the press lever is pressed by the spring to move to the press position, to give a predetermined press force to the both edges of the paper holder.

Since the rotational amount of the lid is large, however, the expansion and contraction of the spring in proportion to its rotational amount makes the spring weak to be deformed in the end. Due to the repetitive opening and closing of the lid, the press force of the press lever becomes non-uniform, which was a problem in reliability.

In order to increase reliability, JPA.No.2001-192521 discloses a link mechanism and a toggle spring to move the press lever in cooperation with opening and closing the lid. The toggle spring is disposed to locate a fulcrum position within a range of movement of the lid, in order to urge the press lever toward the press position or the release position. According to this press mechanism, it is possible to keep the press force constant because the amount of expansion and contraction can be reduced.

However, since the only toggle spring urges the press lever to the rolled recording paper, a large force to move the lid is required around the fulcrum position of the toggle spring. Moreover, when the toggle spring is over the fulcrum position, the press lever moves to the press position at a stroke by its predetermined press force. Owing to this, the press lever catches user's fingers. There is another possibility to cause damage to the both edges of the paper holder after repetitive opening and closing of the lid.

SUMMARY OF THE INVENTION

An object of the present invention is to provide a recording paper storage device to press a paper holder with a paper supply roll stably, and to load the paper holder easily and safely.

In order to achieve the above object, the recording paper storage device of the present invention has a loading lid that is movable between an open position to open a loading chamber in which the recording paper roll is set and a closed position to close the loading chamber, a roll holder to hold both edges of the recording paper roll, a press means to press an edge of the roll holder to the paper-supply roller, and a bias means, when the loading lid is at the open position, to urge the press means by a force smaller than when the loading lid is at the closed position. When the loading lid is open, the press means is urged by the smaller force. Therefore, it is easily possible to attach the roll holder with the recording paper to the loading chamber. In the meantime, when the loading lid is closed, the press means is urged by a strong force. Therefore, it is surely possible to press the recording paper roll to the paper-supply roll.

According to the preferred embodiment, the bias means consists of a torsion coil spring and a compression spring. The press means consists of a first press member and a second press member. The torsion coil spring urges the first press member in a first direction to press the roll holder to the paper-supply roller. The compression spring urges the first press member in the first direction to urge the second press member in a second, opposite direction. The loading lid that moves from the open position to the closed position presses the second press member to rotate in the first direction. When the second press member rotates in the first direction, the compression spring is charged to urge the first press member in the first direction. When the loading lid is closed, the first press member receives the bias of the compression coil spring as well as the bias of the torsion coil spring. Therefore, sufficient force is applied to the recording paper roll, to press to the paper-supply roller.

The roll holder with the recording paper roll is held in the loading chamber with its end inserted into a guide groove formed in the support plate. The first press member and the second press member are attached to the support plate in a rotatable manner. According to this guide groove, one end extends in an approximate vertical direction, and other end extends toward the paper-supply roller, so that the gravity of the roll holder guides the roll holder to the guide groove. When the loading lid is at the open position, the first press member covers a part of the guide groove. When the roll holder is inserted into the guide groove, the gravity of the roll holder rotates the first press member in the second direction against the bias of the torsion coil spring, to expose the guide groove. Consequently, the roll holder can be easily set to the loading chamber.

BRIEF DESCRIPTION OF THE DRAWINGS

The above and other objects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE PREFERRED EMBODIMENTS

Figure 1:
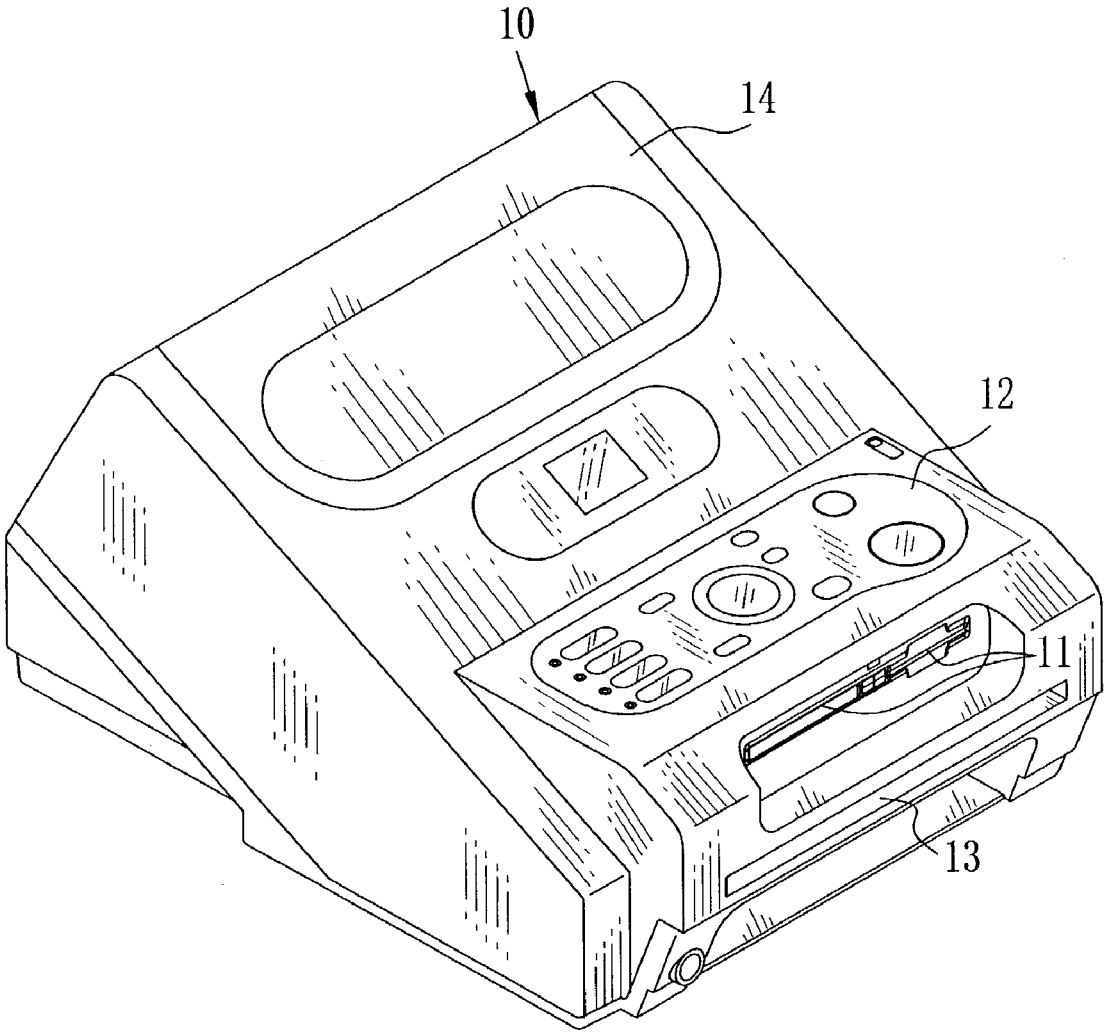
FIG. 1 is a front perspective view of a printer with a recording paper storage device of the present invention, for illustrating a state of a lid being closed.
Figure 2:
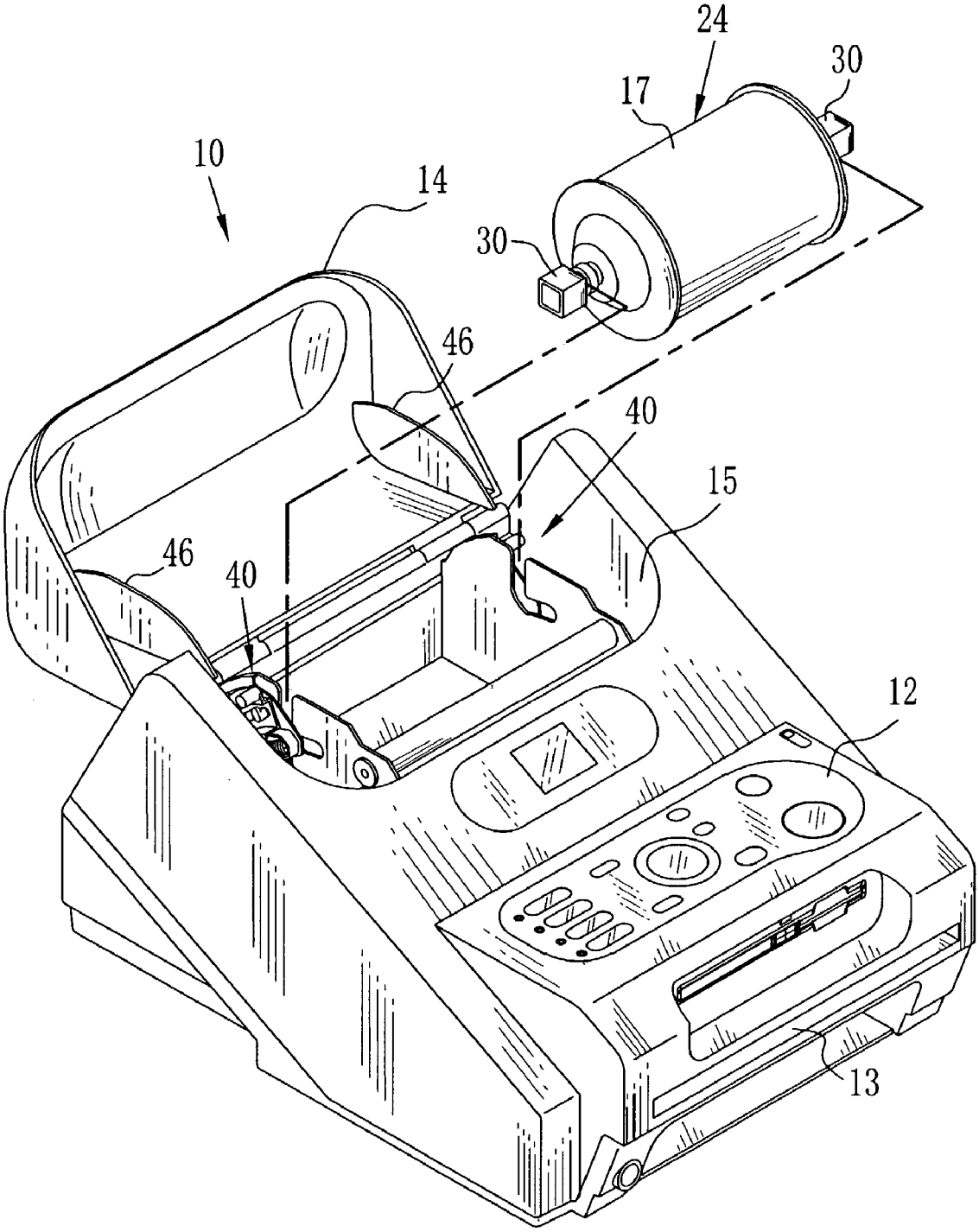
FIG. 2 is a front perspective view of the printer with the lid open.
Figure 3:
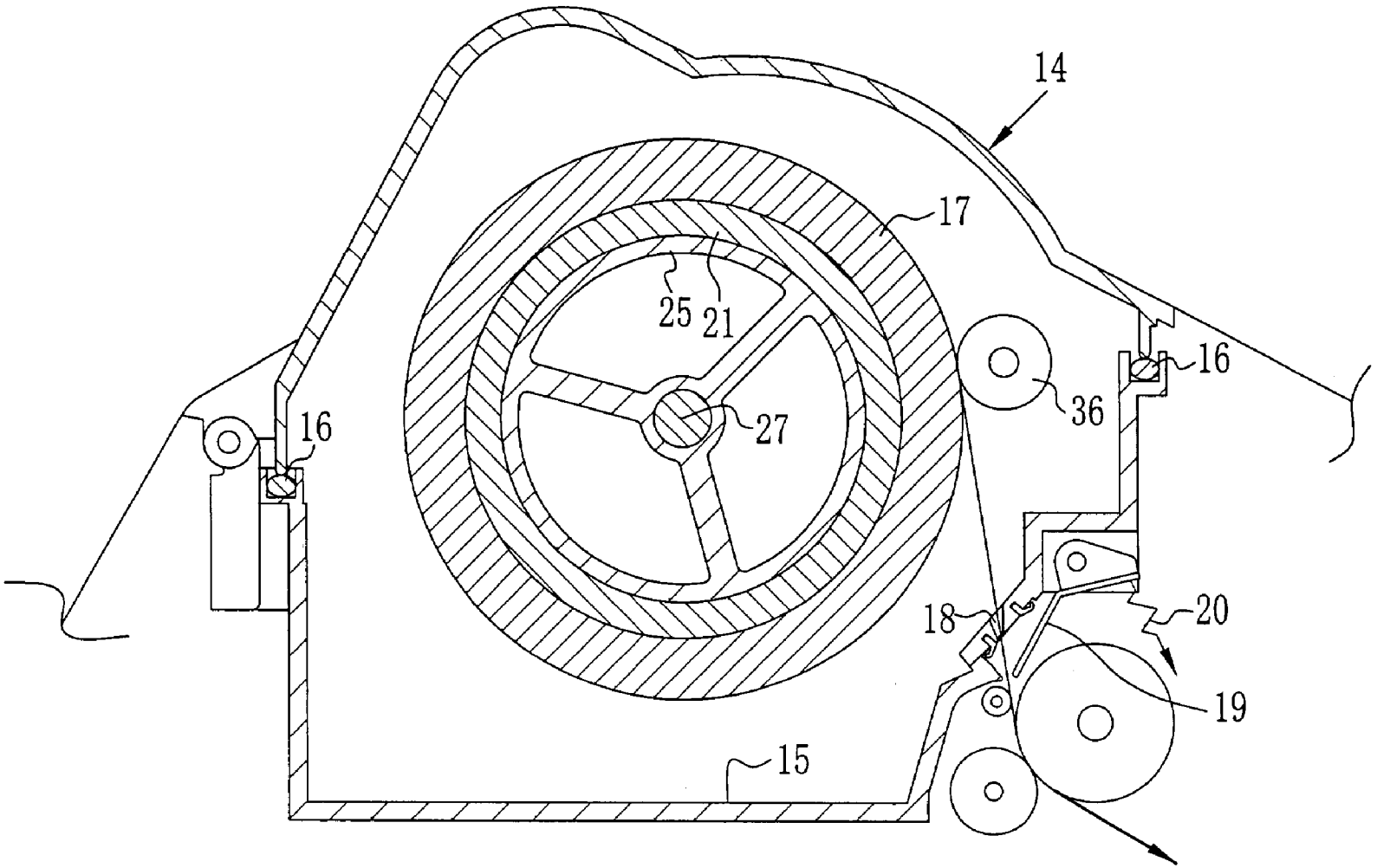
FIG. 3 is a vertical cross section of a central part of the recording paper storage chamber with the lid being closed.

As shown in FIG. 1, a printer 10 has a slot 11, an operation section 12, a recording paper outlet 13, and a loading lid 14 for loading the recording paper, all of which are exposed. A recording medium with image data is set in the slot 11. The printer 10 reads out image data to generate print data, then drives a thermal head on the basis of print data to record an image on the recording paper. The loading lid 14 is locked at a closed position by the not-shown lock mechanism, and is unlocked upon operation of an open-and-close button in the operation section 12. When the loading lid 14 moves to an open position, as shown in FIG. 2, the inside of a recording paper storage chamber 15 is exposed. The loading lid 14 is attached to the recording paper storage chamber 15 so as to open and close it freely. The recording paper storage chamber 15 has the paper-supply function to transmit a drive from the printer body to convey the recording paper into the printer body, and the function to improve light-shielding and air-tightness that protects the stored recording paper. As shown in FIG. 3, the loading lid 14 at the closed position presses a packing 16 on the edge of the recording paper storage chamber 15 so as to keep the inside air-tight. Under the recording paper storage chamber 15, an entrance 18 is formed to pass a belt-like recording paper 17 in and out of the printer 10. A cover lid 19 is attached to the entrance 18. The cover lid 19 is movable between the shielding position to cover the entrance 18 and the open position to open the entrance 18. Normally, the cover lid 19 is urged to the shielding position by a spring 20. A drive member (not shown) on the printer side pushes the cover lid 19 to the open position.

Figure 4:
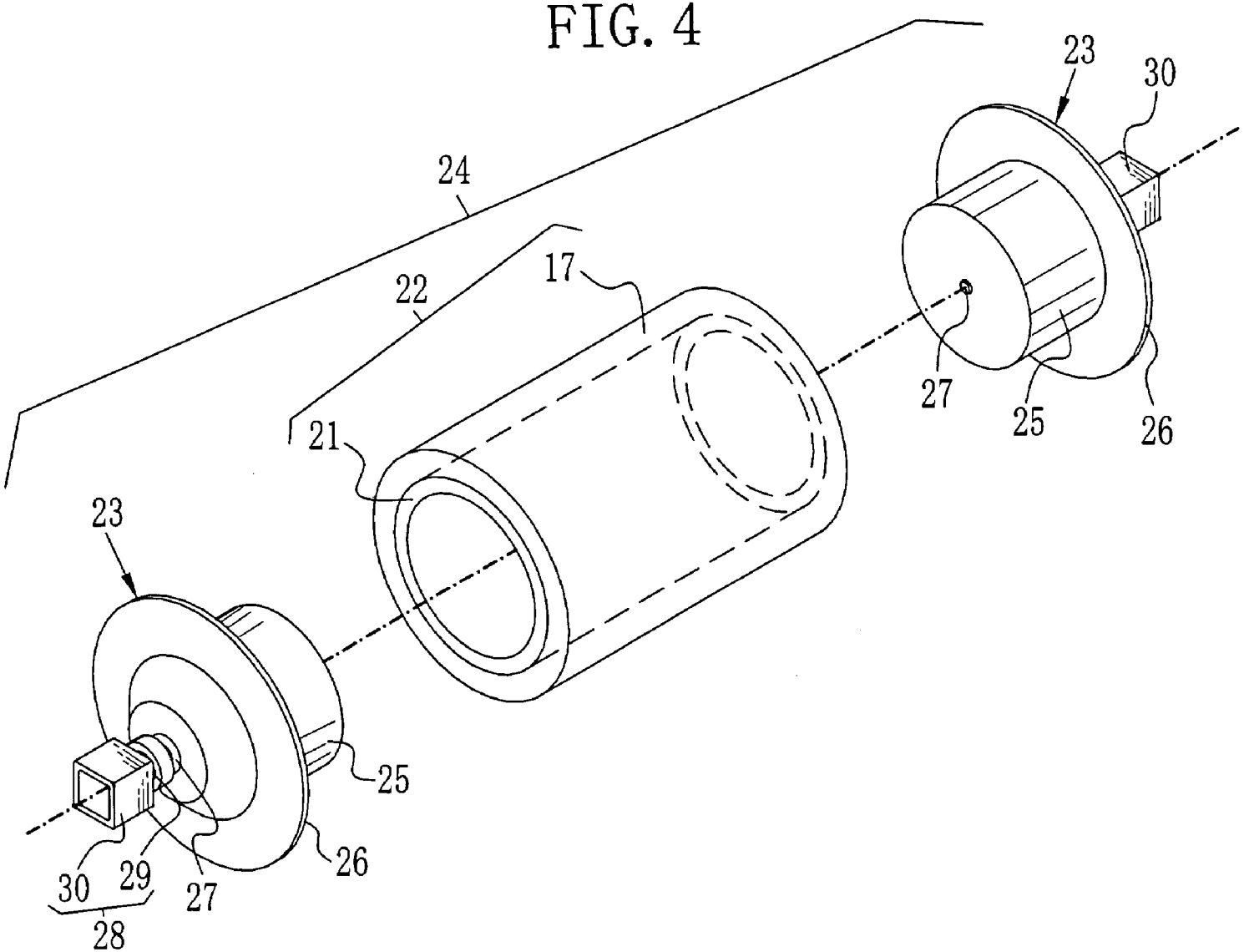
FIG. 4 is an exploded perspective view of a recording paper roll unit.

The belt-like recording paper 17, as shown in FIG. 4, takes the shape of a rolled recording paper 22 rolled around a core 21, whose pipe is hollow in the cross section. A paper holder 23 is respectively fitted into a hole formed in both edges of the core 21. These belt-like recording paper 17, the core 21, and the paper holder pairs 23 organize a recording paper roll unit 24. After use, a new rolled recording paper 22 is attached to the used paper holder 23. The paper holder 23 has a drum section 25, a brim section 26, and a drum shaft 27. The drum section 25 fits an inner periphery of the core 21 to support the core 21. The brim section 26 contacts an edge of the core 21 not to move the core 21 in an axial direction parallel to the rotation axis of the rolled recording paper 21. The drum shaft 27 supports the drum section 25 and the brim section 26 in a rotatable manner. Each of the drum shaft 27 has a shaft support section 28 that has a guide section 29 and a pressed section 30. The guide section 29, which is depressed and round in section, is inserted into a guide groove that is fully mentioned later. The pressed section 30, which is rectangular in section, is attached to the guide section 29 in a rotatable manner. The pressed section 30 is pressed by the first press plate, which will be mentioned in detail.

Figure 5:
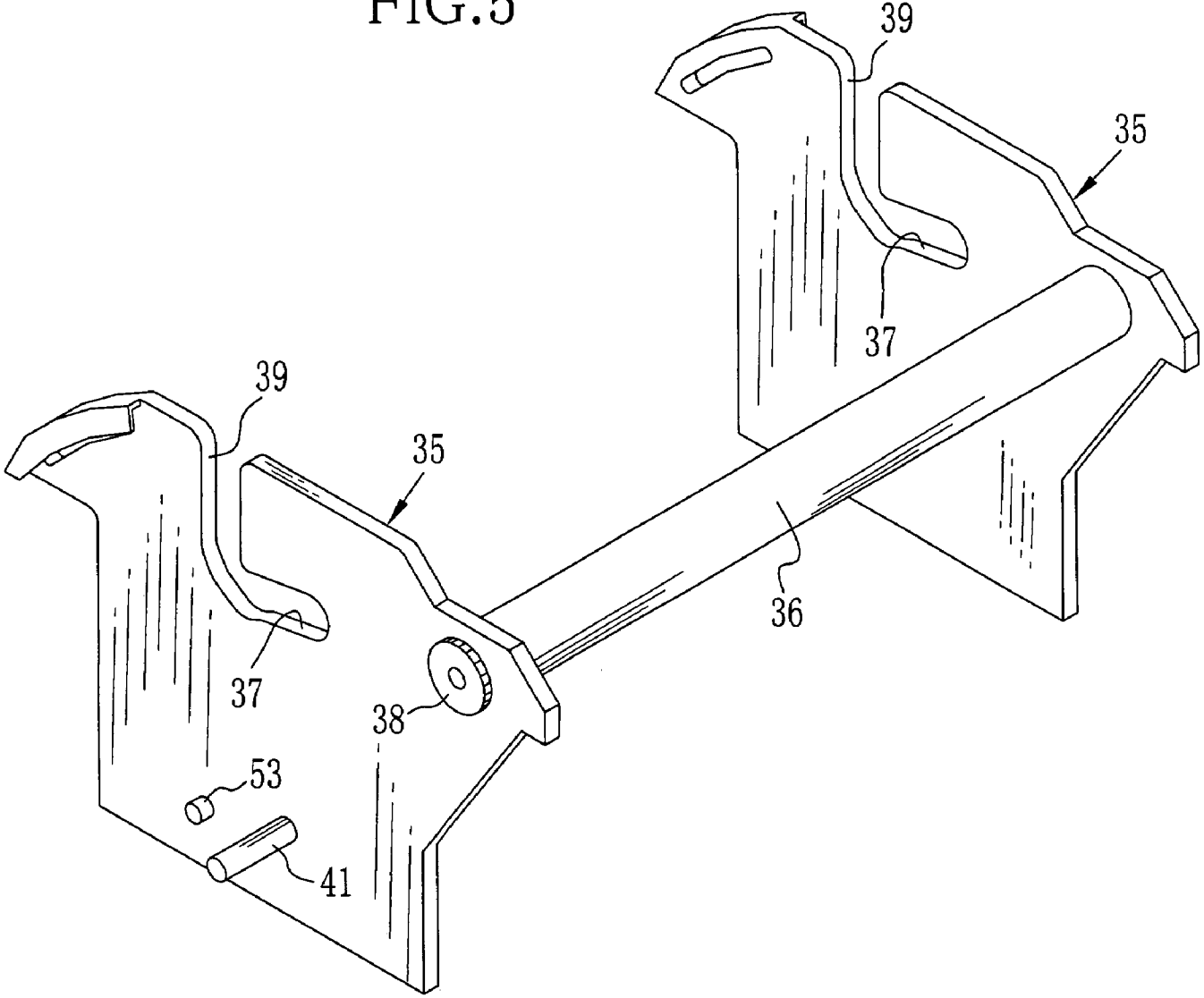
FIG. 5 is a perspective view illustrating an essential part of a support plate attached into the recording paper storage chamber.

As shown in FIG. 5, a pair of support plates 35 is attached face to face to the recording paper storage chamber 15. The pair of support plates 35 support both ends of a paper-supply roller 36 rotatably, and that each has a guide groove 37 in which the guide section 29 is inserted. A gear 38 is attached to one end of the paper-supply roller 36, for transmitting a drive from the printer body. Each of the support plates 35 has an insertion opening 39 which extends vertically and guides the guide section 29 to the guide groove 37 from upward of the printer 10. The guide groove 37 and the insertion opening 39 are joined to form an approximately L-shaped groove in the support plate 35. The guide groove 37 is so formed as to guide the recording paper roll unit 24 toward the paper-supply roller 36 regardless of a diameter of the recording paper roll unit 24 in order that the periphery of the rolled recording paper 22 is kept in contact with the paper-supply roller 36 at all times. In the present embodiment, the guide groove 37 is formed in an approximate horizontal direction parallel to the bottom surface of the printer 10. It is to be noted that the guide groove 37 formed by cutting the support plate 35 is used as a guide member in the above embodiment. In addition to that, it is possible to form a guide member by providing a guide rail or a guide projection on the support plate 35.

Figure 6:
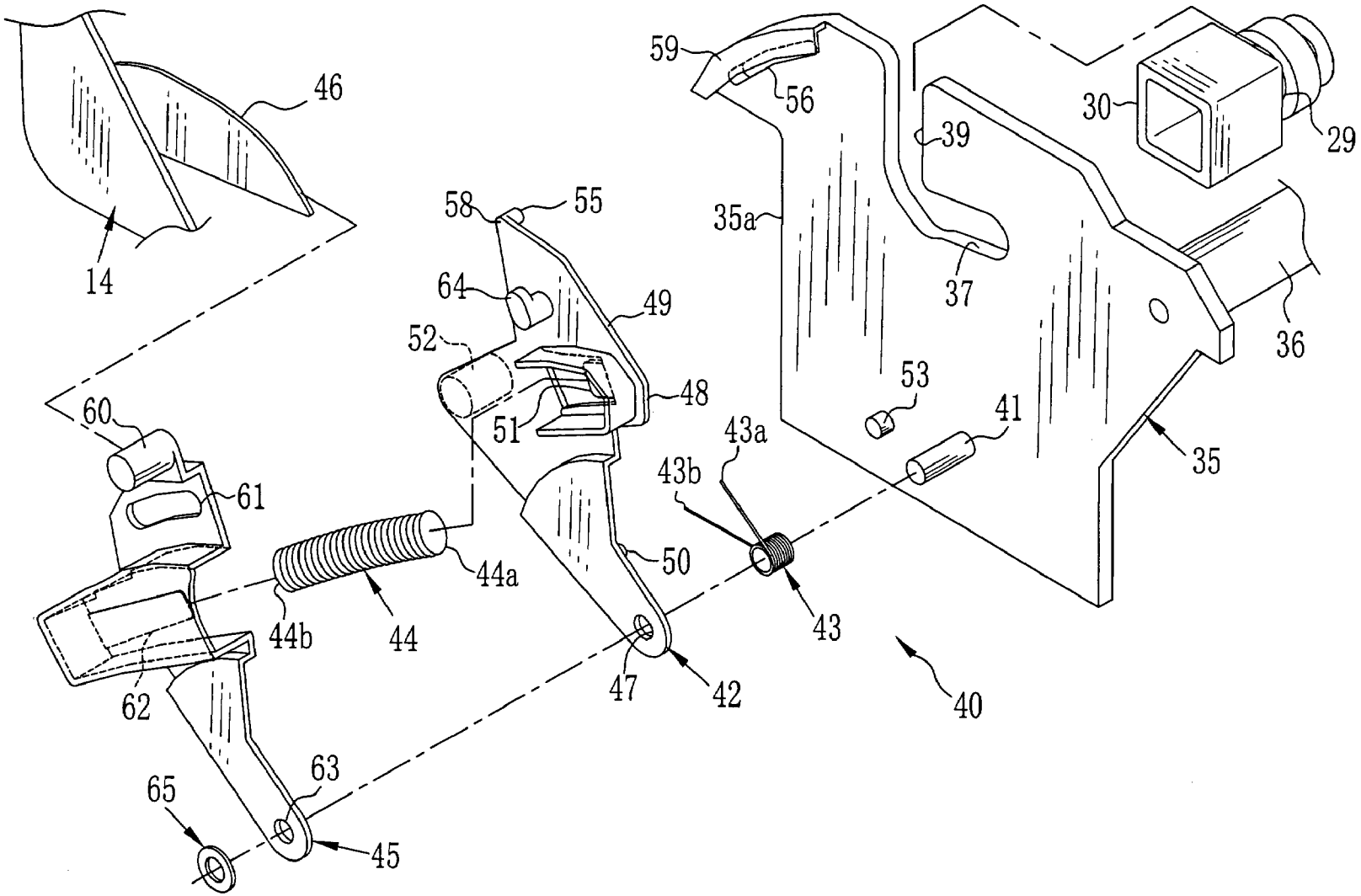
FIG. 6 is an exploded perspective view illustrating an essential part of a press mechanism.
Figure 7:
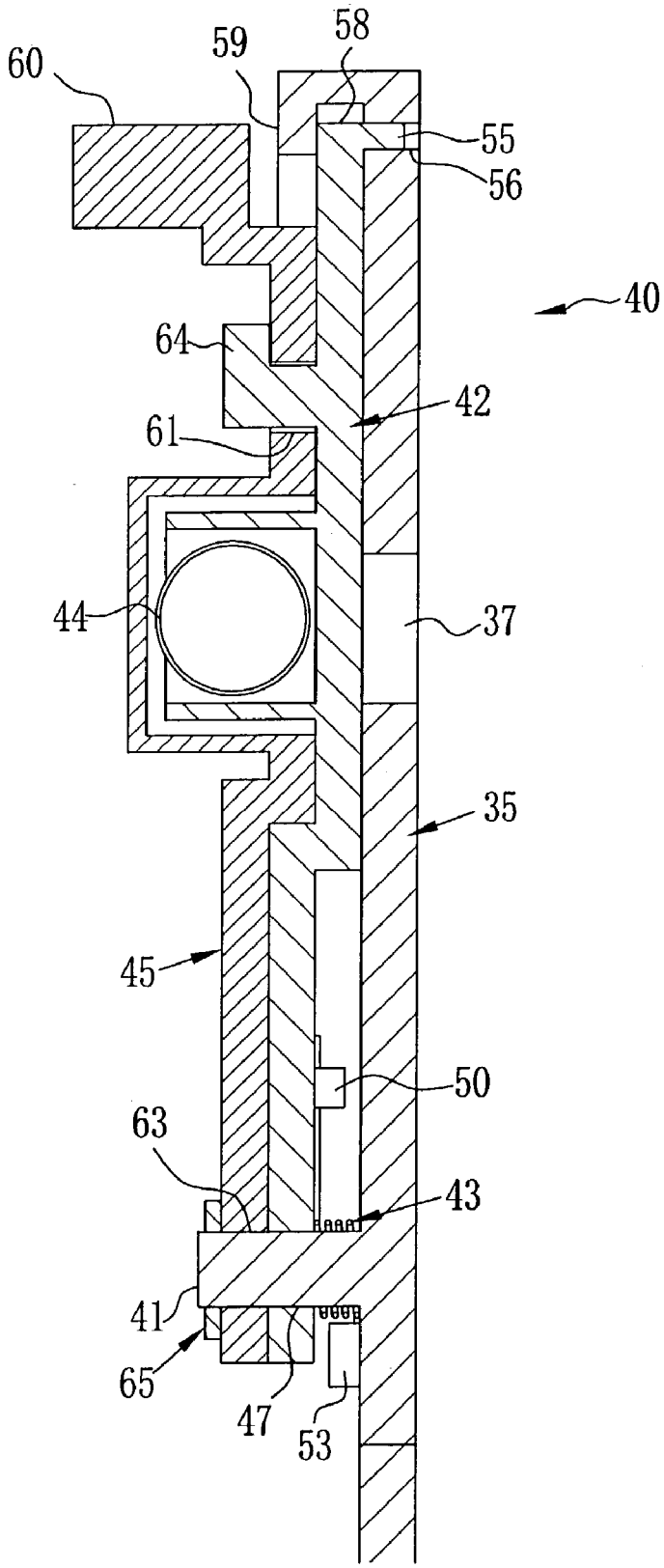
FIG. 7 is a vertical cross section illustrating an essential part of the press mechanism.

A press mechanism 40 is disposed between the support plate 35 and the recording paper storage chamber 15. Each press mechanisms 40, as shown in FIGS. 6 and 7, comprises a shaft 41, a first press plate 42, a torsion coil spring 43, a compression spring 44, a second press plate 45, and a hold-down section 46. The shaft 41 is fixed to the support plate 35, for supporting the first and second press plates 42 and 45 rotatably. The first press plate 42 has a shaft receiver 47, a press section 48, a guide section 49, a spring catcher 50, a spring receiver 51, and a stopper 52.

The first press plate 42 is rotatable around the shaft 41 to which the shaft receiver 47 is attached. One end 43*a* of the torsion coil spring 43 is engaged with a spring catcher 53 in the support plate 35, and other end 43*b* thereof is engaged with the spring catcher 50 in the first press plate 42, so that the press section 48 urges the first press plate 42 in a clockwise direction to cover the guide groove 37 and the insertion opening 39. Due to this, when the recording paper roll unit 24 is loaded, the press section 48 is biased by the torsion coil spring 43 to press the pressed section 30, pressing the outer surface of the rolled recording paper 22 to the paper supply roller 36. The first press plate 42, against the bias of the torsion coil spring 43, moves to the release position to expose the guide shaft 37 and the insertion opening 39, to permit insertion of the guide section 29 into the guide groove 37.

The guide section 29 shifts its position in the guide groove 37 in accordance with the size of the rolled recording paper 22. That is, the position of the guide section 29 is different in case the diameter of the rolled recording paper 22 is the maximum (when the rolled recording paper 22 is replaced with a new one), and in case the diameter of the rolled recording paper 22 is the minimum (when just before the rolled recording paper 22 runs out). When the rolled recording paper 22 is the maximum in the diameter, the guide section 29 is farthest from the paper-supply roller 36. When the rolled recording paper 22 is the minimum, on the other hand, the guide section 29 is located closest to the paper-supply roller 36.

When the recording paper roll unit 24 is not loaded, the first press plate 42 is biased by the torsion coil spring 43 to cover a part of the guide groove 37 and the insertion opening 39. At this time, the guide section 49 obliquely crosses the insertion opening 39. On setting the rolled recording paper 22, the pressed section 30 contacts the guide section 49. Due to the gravity of the rolled recording paper 22, the first press plate 42 rotates in the release position against the bias of the torsion coil spring 43. When the first press plate 42 rotates in the release position, the insertion opening 39 and the guide groove 37 are exposed to permit the guide section 29 to enter the guide groove 37.

The stopper 52 on the first press plate 42 projects towards the support plate 35. The stopper 52 contacts an edge 35*a* of the support plate 35 to limit the rotational amount of the first press plate 42 due to the bias of the torsion coil spring 43. The first press plate 42 has a guide pin 55 projecting towards the support plate 35. The guide pin 55 is engaged with a guide opening 56 formed in the support plate 35. The guide pin 55 is formed on an end portion 58 that is held by a guide plate 59 projecting like a L-shape in the support plate 35, which prevents the first press plate 42 from rotating to slip out of the shaft 41 of the support plate 35. The spring receiver 51 supports an edge 44*a* of the compression spring 44.

The second press plate 45 has a pressed section 60, a guide opening 61, a spring receiver 62, and a shaft receiver 63. On closing the loading lid 14, the pressed section 60 is pressed by the hold-down section 46 fixed to the inner wall of the loading lid 14. The shaft receiver 63 is inserted into the shaft 41 after attaching the first press plate 42. The second press plate 45 is attached over the first press plate 42 to be rotatable around the shaft 41. The rotation of the second press plate 45 is controlled by the engagement between a hook 64 of the first press plate 42 and the guide opening 61 of the second press plate 45. This engagement prevents the second press plate 45 from separating from the first press plate 42 to the axial direction of the shaft 41. The spring receiver 62 supports the other end 44*b* of the compression spring 44. After the attachment of the second press plate 45, a ring stopper 65 is attached to the shaft 41. The compression spring 44 is held between the spring receivers 51 and 62 to urge the first and second press plates 42 and 45 so that the first press plate 42 is away from the second press plate 45.

The operation of the above embodiment is described. The paper holders 23 are fit into holes in both sides of the rolled recording paper 22 to form the recording paper roll unit 24. This makes it possible to treat the recording paper roll unit 24 integrally. After opening the loading lid 14 of the printer 10, the recording paper roll unit 24 is set in the recording paper storage chamber 15. Through this operation, the guide sections 29 on both sides go into the guide groove 37 through the insertion opening 39 of the support plates 35.

Figure 8:
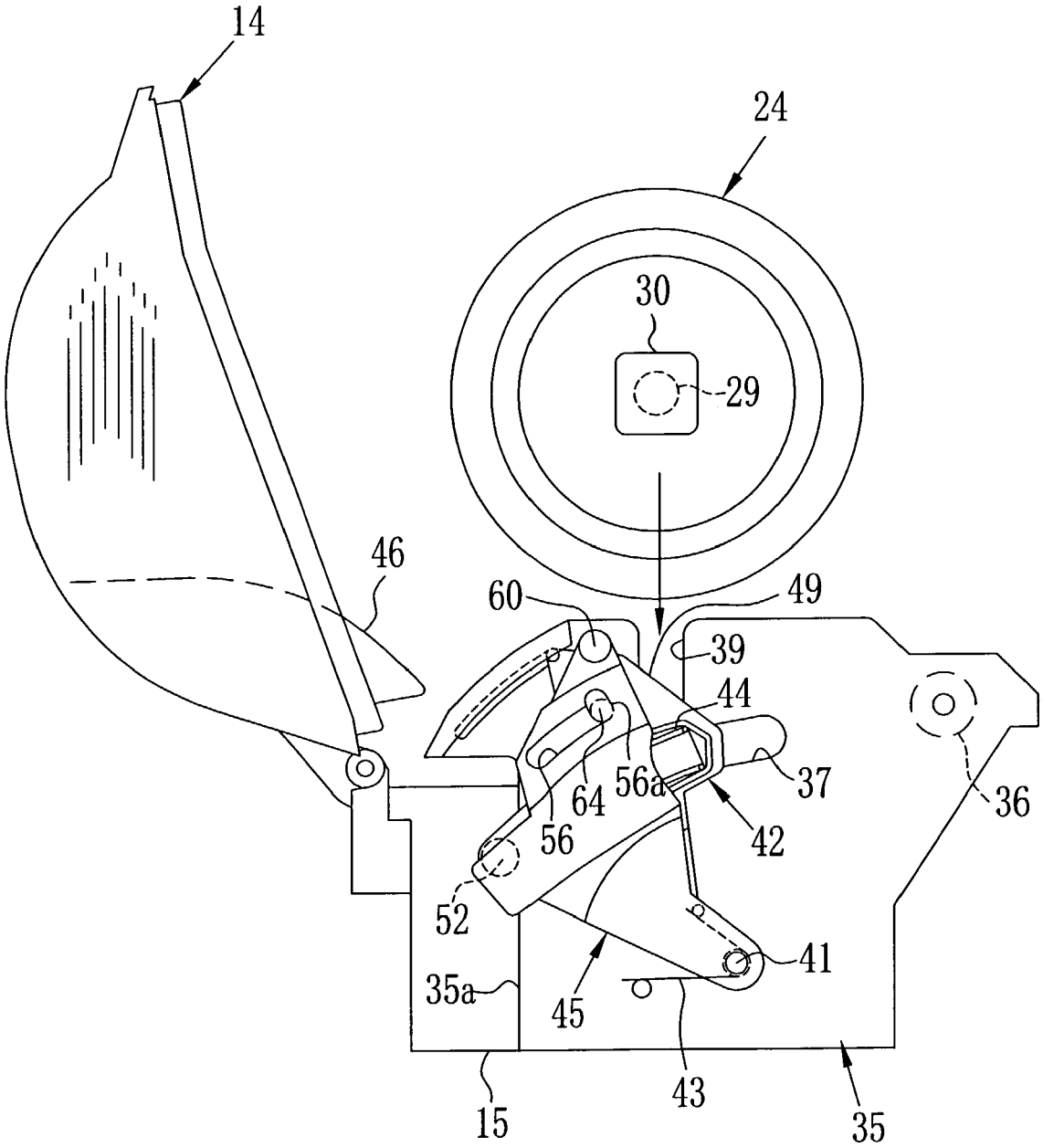
FIG. 8 is a vertical cross section of a recording paper storage chamber in a state where the lid is open.
Figure 9:
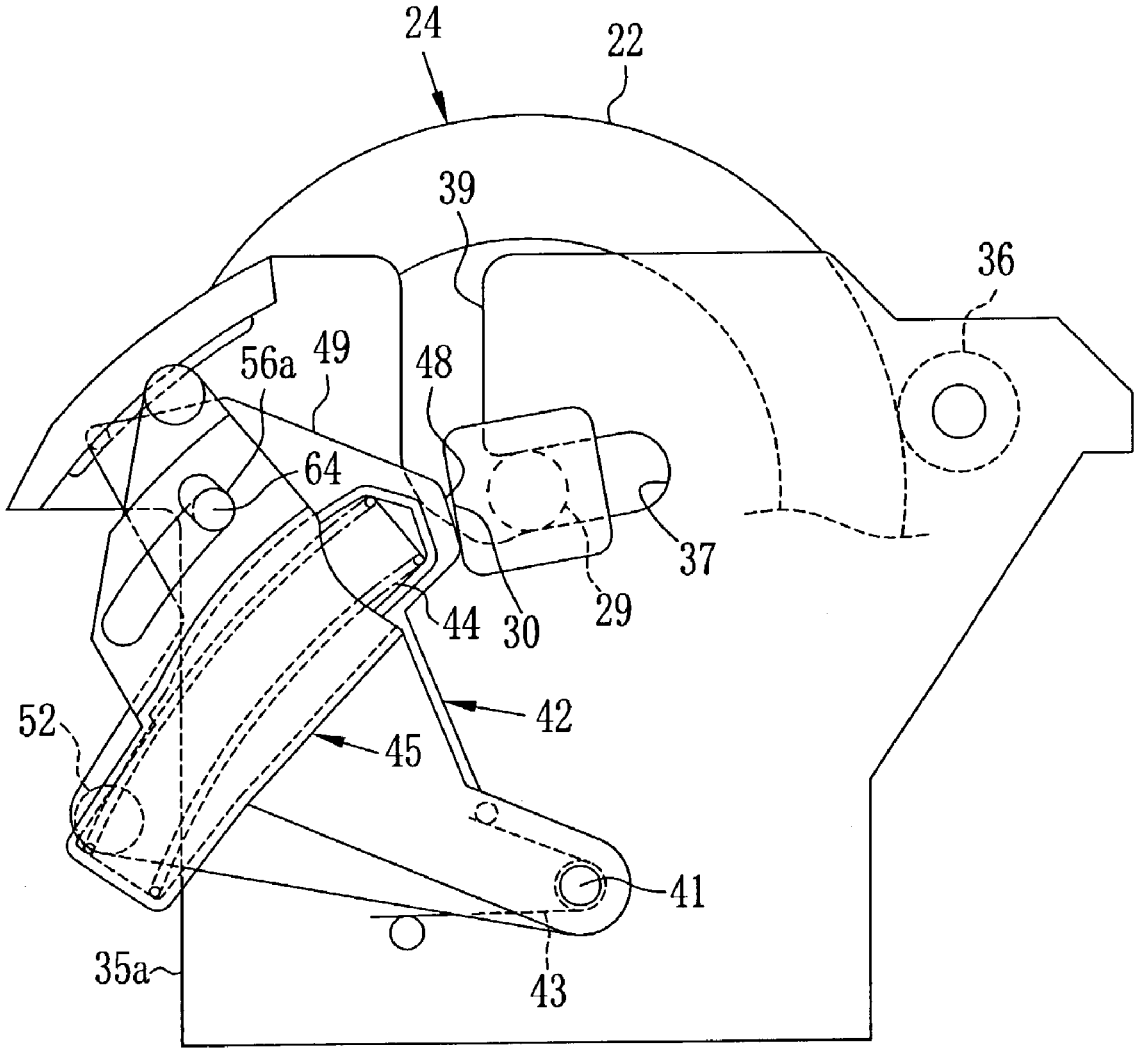
FIG. 9 is an explanatory view of the recording paper storage chamber with the recording paper roll unit wherein the lid is open.

According to the press mechanism 40, as shown in FIG. 8, in a state where the recording paper roll unit 24 is not set, the first press plate 42 is urged by the torsion coil spring 43 to rotate in the clockwise direction around the shaft 41, so that the stopper 52 is held in a position to contact the edge 35*a* of the support plate 35. And the second press plate 45 is urged by the compression spring 44 to rotate in the counterclockwise direction around the shaft 41 from the first hold plate 42. Consequently, the second press plate 45 is kept in state where the hook 64 of the first press plate 42 is engaged with an edge 61*a* of the guide opening 61. In a position shown in FIG. 8, the guide section 49 of the first press plate 42 covers a part of the insertion opening 39 of the support plate 35 so as to prevent the pressed section 30 of the recording paper roll unit 24 from being inserted into the guide groove 37. When the guide section 29 is inserted into the insertion opening 39 from upward, the pressed section 30 contacts the guide section 49. Then, the gravity of the recording paper roll unit 24 presses the first press plate 42 to rotate counterclockwise around the shaft 41 against the bias of the torsion coil spring 43. Owing to this, the first press plate 42 rotates in the release position, to permit the guide section 29 to come into the guide groove 37, as shown in FIG. 9. It is to be noted that the second press plate 45, together with the first press plate 42, rotates counterclockwise upon receipt of the bias of the compression spring 44.

Figure 10:
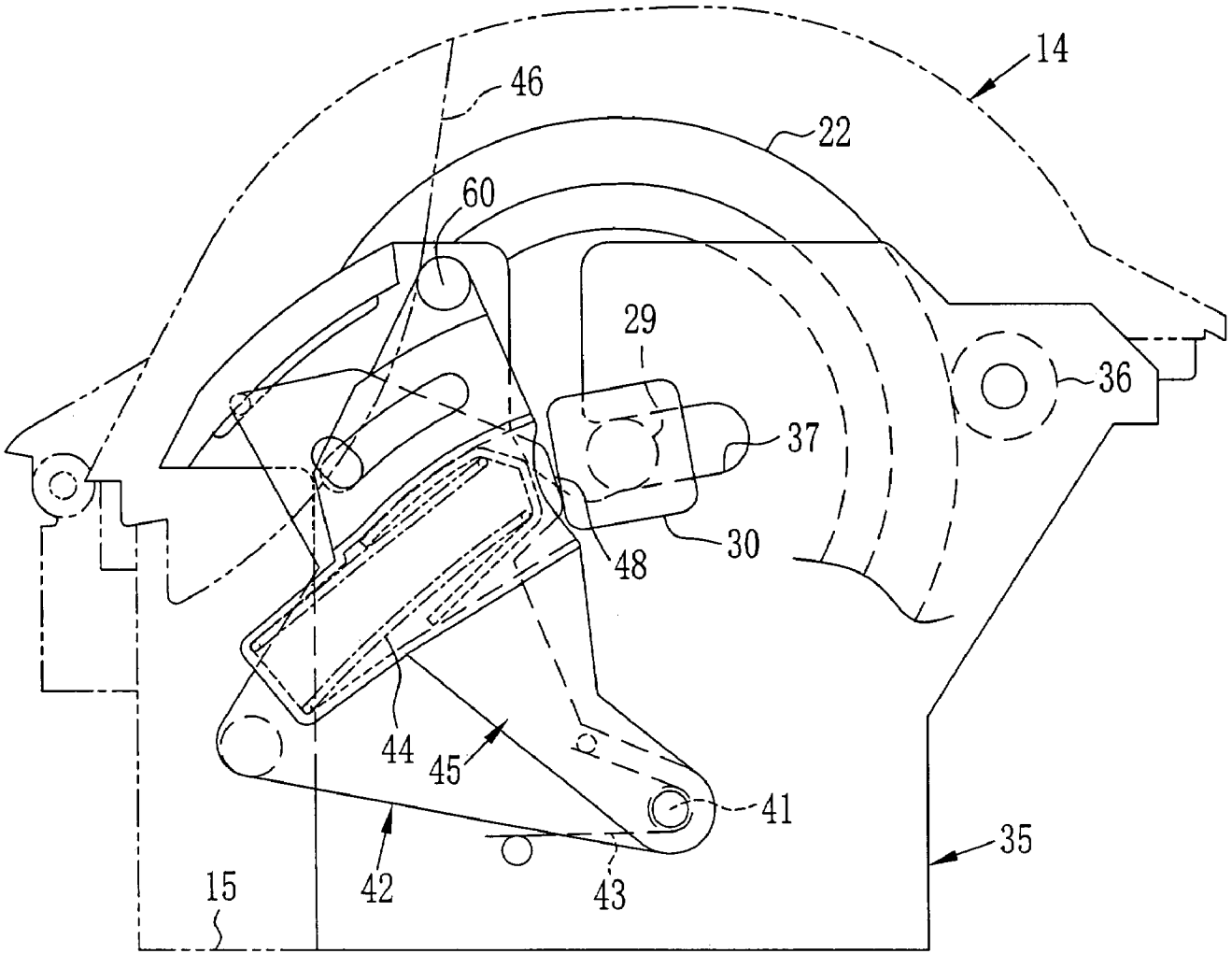
FIG. 10 is an explanatory view of the recording paper storage chamber with the lid closed.

After insertion, the guide section 29 slides into the guide groove 37. The rolled recording paper 22 approaches the paper-supply roller 36, and then its outer surface contacts the paper-supply roller 36. At this time, the press section 48 contacts the pressed section 30 by a mere urge of the torsion coil spring 43. Then the loading lid 14 moves from the open position to the close position to close the recording paper storage chamber 15. When the loading lid 14 moves over the middle position of the open position and the closed position, the hold-down section 46 contacts and presses the pressed section 60 of the second press plate 45 to rotate clockwise in the drawing. As shown in FIG. 10, the second press plate 45 receives the force to rotate in the clockwise direction around the shaft 41 against the bias of the compression spring 44, namely in a direction close to the first press plate 42. At that time, the first press plate 42 is not able to rotate in the clockwise direction because the press section 48 is in contact with the pressed section 30. Consequently, the second press plate 45, in cooperation with the first press plate 42, rotates to compress the compression spring 44. Opposing force caused by compressing this compression spring 44 is applied to the first press plate 42 to urge it in the clockwise direction. This opposing force is added to the force to rotate the first press plate 42 by the bias of the torsion coil spring 43. Thus, it is possible to press the recording paper roll unit 24 to the paper-supply roller at a stronger force than inserting the recording paper roll unit 24. Moreover, since the compression spring 44 is not largely deformed when the lid 14 is open, it is possible to prevent the compression spring from becoming weak. It is to be noted that the loading lid 14 is held at the closed position by the lock mechanism.

Figure 11:
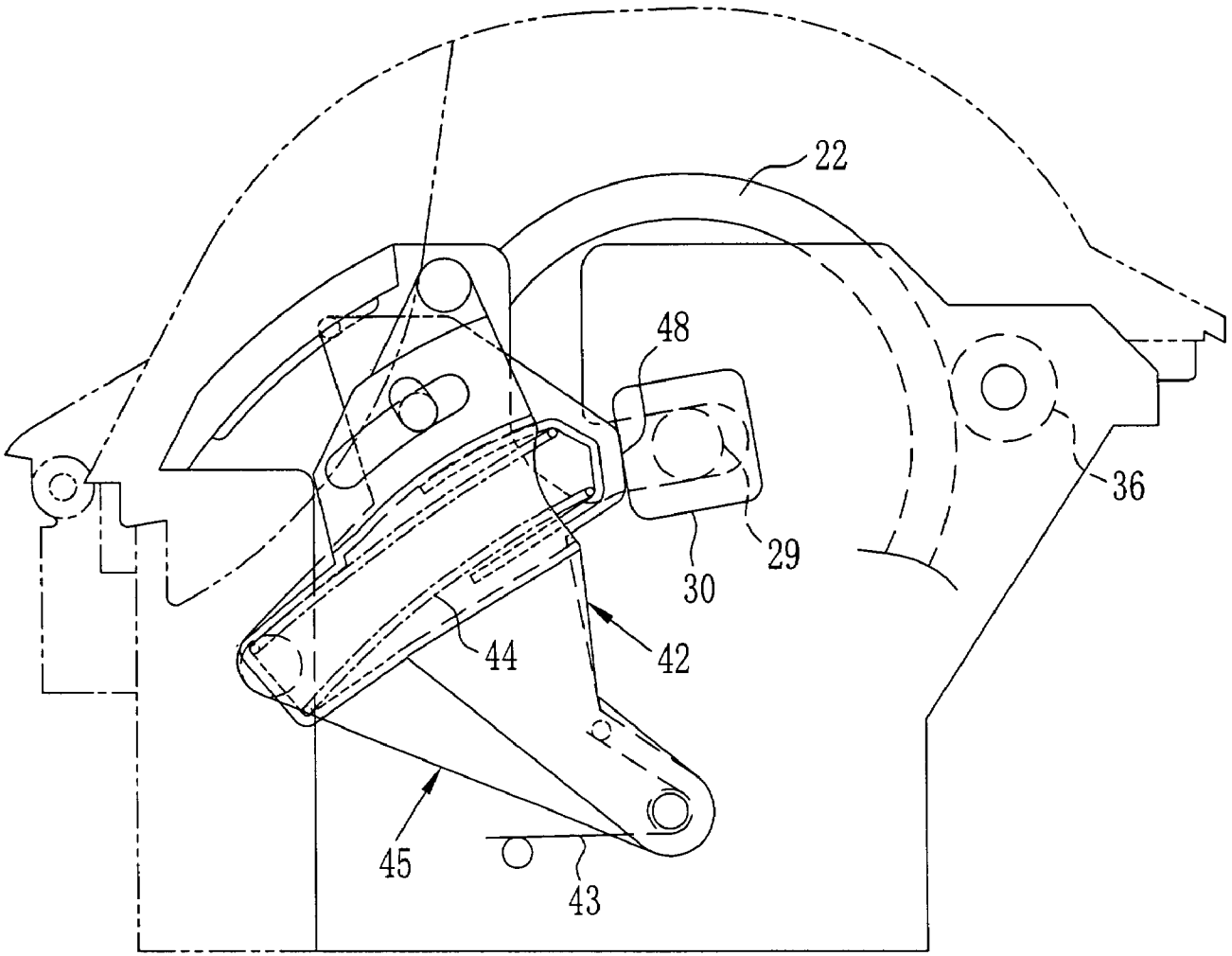
FIG. 11 is an explanatory view of the recording paper storage chamber with the lid closed, illustrating a state in which the remaining amount of the recording paper is decreased.

As the roll diameter of the rolled recording paper 22 gets smaller, the guide section 29 comes closer to the paper-supply roller 36. As the guide section 29 approaches the paper-supply roller 36, as shown in FIG. 11, the bias of the torsion coil spring 43 and the compression spring 44 rotates the first press plate 42 in the clockwise direction around the shaft 41, to make the press section 48 keep pressing the pressed section 30. The diameter of coil, line, roll, and length in the compression spring 44 are determined during the process so that the press force to press the outer periphery of the rolled recording paper 22 to the paper-supply roller 36 is kept within a predetermined range.

Figure 12:
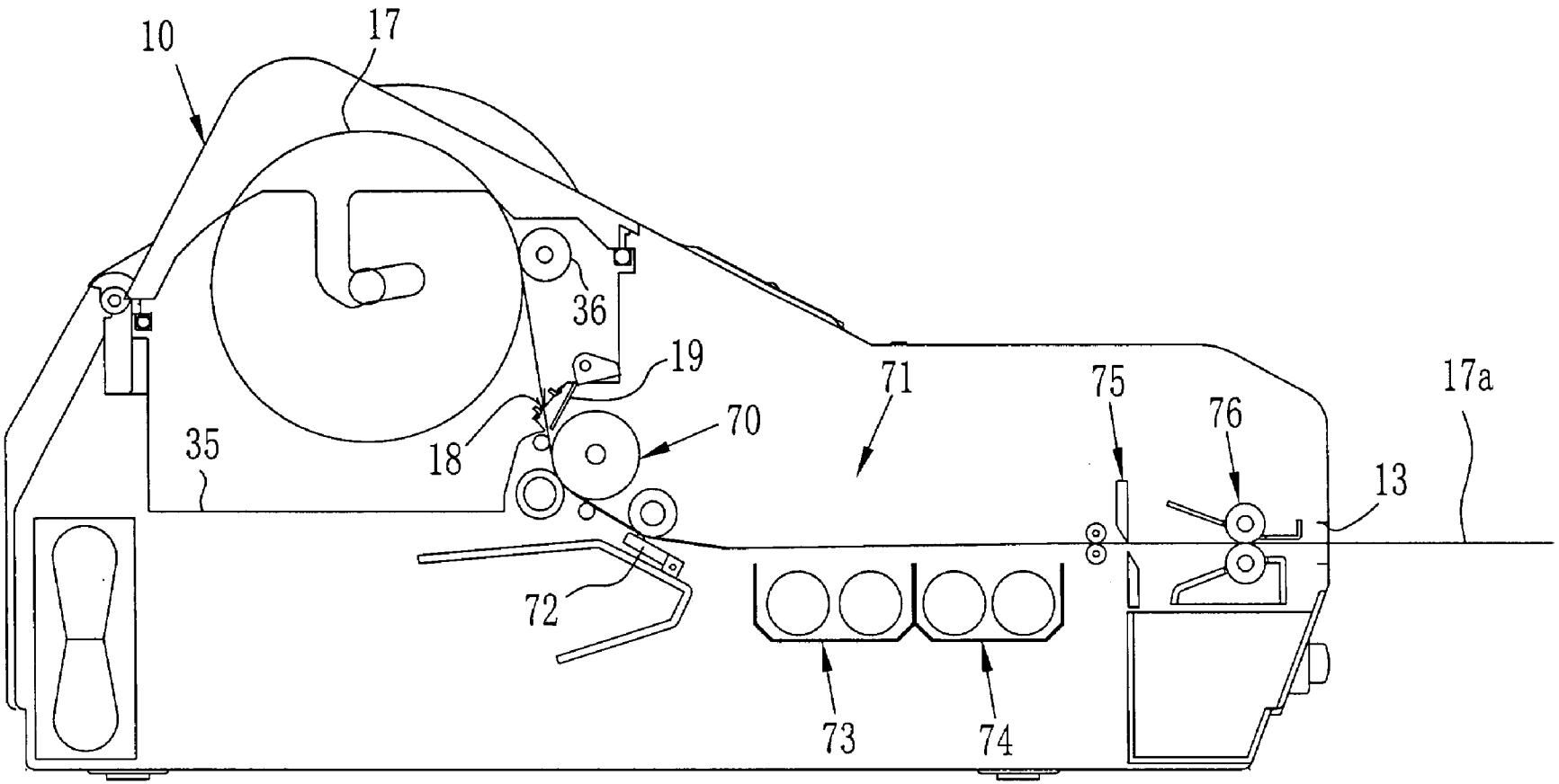
FIG. 12 is an explanatory view illustrating inner structure of the printer.

As a recording paper for the printer, a color thermosensitive recording paper is used. Upon printing operation, as shown in FIG. 12, the printer 10 drives the drive section to open the cover lid 19, then makes a motor on the printer side to rotate the paper-supply roller 36. The paper-supply roller 36 transports the belt-like recording paper 17 inside the printer 10 via the entrance 18.

And a pair of convey rollers 70 transports the belt-like recording paper 17 to a recording section 71, where a thermal head 72 performs three-color sequential recording of yellow, magenta, and cyan. Then, a yellow light fixer 73 and a the magenta light fixer 74 perform fixation while conveying the belt-like recording paper 17 back and force in a direction of conveyance. After recording operation, the belt-like recording paper 17 is conveyed to a cutter section 75, where the cutter is activated after the preset cut position of the belt-like recording paper 17 is matched to the cut position. Therefore, a recording paper 17*a* with the image recorded is separated from the belt-like recording paper 17 to a single sheet, and ejected from the recording paper outlet 13 to the outside of the printer 10 by an ejection roller pairs 76. In case of successive printing, after the edge is returned to the recording section 71, the next image is recorded on the belt-like recording paper 17 in the same way as before. Upon completion of printing, the conveyance roller pairs 70 and the paper-supply roller 36 are rotated reversely to restore the leading end of the belt-like recording paper 17 into the recording paper storage chamber 15. It is to be noted that this restoring amount is predetermined, so as not to pull the leading end of the belt-like recording paper 17 over the paper-supply roller 36.

The rolled recording paper 22 is replaced in the following manner. Upon operation of the open-and-close button on the operation section 12 of the printer 10, the lock mechanism is unlocked. When the loading lid 14 makes rotation toward the open position, the hold-down section 46 separates from the pressed section 60 of the second press plate 45. Then, the second press plate 45 receives the bias of the compression spring 44 to rotate counterclockwise around the shaft 41. In other words, the second press plate 45 rotates in a direction away from the first press plate 42 to be the state as shown in FIG. 9. At this moment, since the bias of the compression spring 44 is released, only the torsion coil spring 43 biases the first press plate 42 toward the paper-supply roller 36. After that, the guide section 29 in the guide groove 37 is pushed toward the insertion opening 39 by holding and moving the both edges of the pressed section 30. Thereby, the first press plate 42 is rotated to the release position against the bias of the torsion coil spring 43. This operation does not require large force because it is conducted against the bias of the only torsion coil spring 43, realizing an easy operation by small force. By rotating the first press plate 42 to the release position in this way, it is possible to take the recording paper roll unit 24 outside of the recording paper storage chamber 15. The recording paper roll unit 24 is disassembled into the paper holders 23 and the core 21. The paper holders 23 with a new rolled recording paper 22 are set to the recording paper storage chamber 15 to complete the replacement operation.

According to the above embodiment, the first and second press plates 42 and 45 are constructed to rotate in the same direction so as to apply the press force. As another embodiment, however, it is possible to construct the press plates that slide straight in respectively different direction so as to apply the press force. A pull spring is used in this case. When the second press plate goes away from the first press plate, the bias of the pull spring is applied to the first press plate, and when the second press plate approaches the first press plate, the bias is released.

Moreover, the above embodiment uses the press mechanism that presses the rolled recording paper 22 to paper-supply roller 36. On the contrary to this, it is possible to press the paper-supply roller 36 to the rolled recording paper 22, or to move the both to press to each other. In the above embodiment, the press mechanism is disposed in the recording paper storage chamber 15 of the printer 10. It is not limited to this but possible to provide the press mechanism in the paper-supply cartridge which is attachable to the printer 10. In this case, the rolled recording paper 22 is set to the paper-supply cartridge. Furthermore, for the use of the paper-supply cartridge, it is possible to omit the paper-supply roller 36 by incorporating the paper-supply roller 36 in the printer side. In that case, an opening is formed in the paper-supply cartridge so that the paper-supply roller can enter the paper-supply cartridge on setting the paper-supply cartridge to the printer 10. The paper-supply roller which enters via the opening contacts the outer surface of the rolled recording paper. The rolled recording paper is pressed towards the paper-supply roller by the first press plate. It is preferable that the opening of the paper-supply cartridge is covered by a lid when removing the paper-supply cartridge out of the printer.

The color thermosensitive printer is used in the above embodiment. However, it is possible to apply a photo printer of silver salt type or a paper-supply cartridge of the printing paper used therefor. Moreover, the present invention is applicable to a printer or paper-supply cartridge for normal sheet which does not require the process of light-shielding and moisture-proofing.

Although the present invention has been fully described by the way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A recording paper storage device for setting a rolled recording paper to a loading chamber, said rolled recording paper in said loading chamber being pressed to a paper-supply roller, said recording paper storage device comprising;

a loading lid movable between an open position to open said loading chamber and a closed position to cover said loading chamber;

press means for pressing said rolled recording paper, said press means being movable in a first direction to press said rolled recording paper to said paper-supply roller, and in a second direction not to press said rolled recording paper to said paper supply roller, said second direction being opposite to said first direction; and bias means for urging said press means to said first direction, when said loading lid is at said open position, said bias means urging said press means by force smaller than when said loading lid is at said closed position.

2. A recording paper storage device as claimed in claim 1, wherein said bias means has a first bias member and a second bias member, said first bias member always urging said press means in said first direction, said second bias member not urging said press means when said loading lid is at said open position but urging said press means in said first direction when said loading lid is at said closed position.

3. A recording paper storage device as claimed in claim 1, further comprising a pair of roll holders to hold both edges of said rolled recording paper, said press means pressing an axis of said roll holder.

4. A recording paper storage device as claimed in claim 3, wherein said press means has a first press member and a second press member connected to each other, said first press member being urged by said first bias member to press said roll holder in said first direction, said second bias member urging said second press member in said second direction when said loading lid is at said open position, and urging said first press member in said first direction when said loading lid is at said closed position.

5. A recording paper storage device as claimed in claim 4, further comprising:

a support plate fixed in said loading chamber, said roll holder being held by said support plate in state where said roll holder is inserted into a guide groove formed in said support plate, said first press member and said second press member being attached to said support plate in a rotatable manner.

6. A recording paper storage device as claimed in claim 5, wherein said first bias member is a torsion coil spring, one end of said torsion coil spring is attached to said first press member and another end thereof is attached to said support plate.

7. A recording paper storage device as claimed in claim 6, further comprising a stopper for limiting a rotational amount of said first press member.

8. A recording paper storage device as claimed in claim 5, wherein said second bias member is a compression spring which urges said first press member in said first direction and urges said second press member in said second direction.

9. A recording paper storage device as claimed in claim 8, wherein said second press member is pressed by said loading lid which moves from said open position to said closed position to rotate in said first direction, said compression spring is charged to urge said first press member in said first direction when said second press member rotates in said first direction.

10. A recording paper storage device as claimed in claim 5, wherein said guide groove is approximately L-shape, one end of said guide groove extends in an approximately vertical direction and the other end thereof extends toward said paper-supply roller, said roll holder is inserted into said guide groove by gravity of said roll holder.

11. A recording paper storage device as claimed in claim 10, wherein said first press member covers a part of said guide groove, said first press member rotates in said second direction to expose said guide groove when said roll holder is inserted into said guide groove.

12. A recording paper storage device as claimed in claim 5, wherein said paper-supply roller is fixed to said support plate.

13. A recording paper storage device for setting a rolled recording paper to a loading chamber, said rolled recording paper in said loading chamber being pressed to a paper-supply roller, said recording paper storage device comprising;

a loading lid movable between an open position to open said loading chamber and a closed position to cover said loading chamber;

a pair of roll holders for holding both edges of said rolled recording paper;

a first press member for pressing said roll holder, said first press member being movable in a first direction, to press said roll holder to said paper-supply roller,and in a second direction not to press said roll holder to said paper-supplv roller, said second direction being opposite to said first direction;

a first bias member for urging said first press member in said first direction;

a second press member that is movable in said first direction and said second direction with said first press member engaged, said second press member being pressed in said first direction when said loading lid moves to said closed position; and a second bias member that urges said second press member in said second direction when said loading lid is at said open position, and urges said first press member in said first direction when said loading lid is at said closed position.

14. A recording paper storage device as claimed in claim 13, further comprising:

a support plate fixed in said loading chamber, said roll holder being held by said support plate in state where said roll holder being inserted into a guide groove formed in said support plate, said first press member and said second press member being attached to said support plate in a rotatable manner.

15. A recording paper storage device as claimed in claim 14, wherein said second press member is pressed by said loading lid which moves from said open position to said closed position to rotate in said first direction, said second bias member is charged to urge said first press member in said first direction when said second press member rotates in said first direction.

16. A recording paper storage device as claimed in claim 14, wherein said guide groove is approximately L-shape, one end of said guide groove extends in an approximately vertical direction and the other end thereof extends toward said paper-supply roller, said roll holder is inserted into said guide groove by gravity of said roll holder.

17. A recording paper storage device as claimed in claim 16, wherein said first press member covers a part of said guide groove, said first press member rotates in said second direction to expose said guide groove when said roll holder is inserted into said guide groove.

* * * * *